US009523208B2

(12) United States Patent
Athanasiou et al.

(10) Patent No.: US 9,523,208 B2
(45) Date of Patent: Dec. 20, 2016

(54) PORTABLE KIT FOR ERECTING A TEMPORARY SHELTER, AND METHOD OF USING SAME

(71) Applicants: Al S. Athanasiou, Fond Du Lac, WI (US); Ralph Thomas Varney, Oshkosh, WI (US)

(72) Inventors: Al S. Athanasiou, Fond Du Lac, WI (US); Ralph Thomas Varney, Oshkosh, WI (US)

( * ) Notice: Subject to any disclaimer, the term of this patent is extended or adjusted under 35 U.S.C. 154(b) by 0 days.

(21) Appl. No.: 14/695,450

(22) Filed: Apr. 24, 2015

(65) Prior Publication Data

US 2015/0308135 A1 Oct. 29, 2015

Related U.S. Application Data

(60) Provisional application No. 61/984,472, filed on Apr. 25, 2014.

(51) Int. Cl.

| | |
|---|---|
| ***E04H 9/00*** | (2006.01) |
| ***E04H 1/12*** | (2006.01) |
| *E04B 1/343* | (2006.01) |
| *E04B 1/61* | (2006.01) |

(52) U.S. Cl.

CPC ..... *E04H 1/12* (2013.01); *E04B 1/34321* (2013.01); *E04B 1/6183* (2013.01); *E04B 2001/34389* (2013.01)

(58) Field of Classification Search

CPC ..... E04H 1/02; E04H 1/12; E04H 9/16; E04H 9/145; E04B 1/34384; E04B 1/34321

USPC ..... 52/64, 66, 70, 71, 79.5; 446/478, 488

See application file for complete search history.

(56) References Cited

U.S. PATENT DOCUMENTS

| | | | | | |
|---|---|---|---|---|---|
| 2,441,076 | A | * | 5/1948 | Makrianes | 446/75 |
| 2,894,290 | A | * | 7/1959 | Lundstedt | B60P 3/34 296/173 |
| 3,387,733 | A | | 6/1968 | Field | |
| 3,629,875 | A | * | 12/1971 | Dow et al. | 4/599 |
| 3,838,545 | A | * | 10/1974 | Kump | 52/79.8 |
| 3,984,953 | A | * | 10/1976 | Kump | 52/143 |
| 4,272,930 | A | | 6/1981 | Foster | |
| 4,584,805 | A | * | 4/1986 | Meiry | 52/264 |
| 5,083,410 | A | | 1/1992 | Watson | |
| 5,184,436 | A | | 2/1993 | Sadler | |
| 5,319,904 | A | | 6/1994 | Pascoe | |
| 5,447,000 | A | | 9/1995 | Larsen | |
| 5,611,449 | A | * | 3/1997 | Pedersen | E04B 1/3445 220/1.5 |
| 5,657,583 | A | | 8/1997 | Tennant | |
| 5,724,774 | A | * | 3/1998 | Rooney | 52/79.5 |

(Continued)

FOREIGN PATENT DOCUMENTS

| | | | |
|---|---|---|---|
| JP | WO2007063651 | A1 * | 6/2007 |
| WO | 00/66846 | A1 | 11/2000 |

(Continued)

*Primary Examiner* — Adriana Figueroa

(74) *Attorney, Agent, or Firm* — Carrier Blackman & Associates, P.C.; William D. Blackman; Anne G. Sabourin

(57) ABSTRACT

A portable shelter kit is usable for erecting a temporary or long term structural shelter. The portable shelter kit includes a two-part shipping container which comes apart into pieces which are usable as component parts of the shelter. A method of using the kit to construct a portable shelter is also described.

11 Claims, 13 Drawing Sheets

(56) References Cited

U.S. PATENT DOCUMENTS

| | | | | |
|---|---|---|---|---|
| 6,088,969 | A * | 7/2000 | Bigelow | 52/90.1 |
| 6,331,147 | B1 * | 12/2001 | Munro | A63H 33/32 446/478 |
| 6,948,280 | B2 * | 9/2005 | Marcinkowski et al. | 52/79.1 |
| 8,381,455 | B2 | 2/2013 | Schooley | |
| 8,613,166 | B2 * | 12/2013 | Smith | 52/66 |
| 8,943,758 | B2 * | 2/2015 | Miller | 52/79.5 |
| 2008/0263968 | A1 | 10/2008 | Day | |
| 2009/0223143 | A1 | 9/2009 | Esposito | |
| 2011/0185644 | A1 | 8/2011 | Hutter | |
| 2013/0074894 | A1 * | 3/2013 | Cook | 135/96 |

FOREIGN PATENT DOCUMENTS

| | | | |
|---|---|---|---|
| WO | WO 2007063651 | A1 * | 6/2007 |
| WO | WO 2014081347 | A2 * | 5/2014 |

* cited by examiner

PORTABLE KIT FOR ERECTING A TEMPORARY SHELTER, AND METHOD OF USING SAME

CROSS-REFERENCE TO RELATED APPLICATIONS

The present application claims priority under 35 U.S.C. 119(e), based on U.S. provisional patent application 61/984,472, filed 25 Apr. 2014. The entire disclosure of this priority document, including specification, claims, and drawings, is incorporated by reference herein.

BACKGROUND OF THE INVENTION

1. Field of the Invention

The present invention relates to a portable shelter kit which is usable for erecting a temporary or long term shelter, and to a method of using the kit to construct a shelter. More particularly, the present invention relates to a portable shelter kit including a two-part shipping container which comes apart into pieces which are usable as component parts of the shelter.

2. Description of the Background Art

Sometimes, in the aftermath of extreme weather events such as floods, hurricanes or other storms, or in other situations such as forced relocations or the like, where people have temporarily been rendered homeless, there is a need for quickly erectable temporary housing. A need also exists for storage structures which can be quickly and easily assembled in times of need.

A number of different kits are known for use in erecting temporary housing or storage structures.

Examples of some of the known temporary housing or storage structures include those described in Field, U.S. Pat. No. 3,387,733, Foster, U.S. Pat. No. 4,272,930, Watson, U.S. Pat. No. 5,083,410, Sadler, U.S. Pat. No. 5,184,436, Larsen, U.S. Pat. No. 5,447,000, Pascoe, U.S. Pat. No. 5,319,904, Tennant, U.S. Pat. No. 5,657,583, Schooley, U.S. Pat. No. 8,381,455, Helin et al., International Application WO 00/66846, Day, US publication 2008-0263968, Esposito US published application 2009-0223143, and Hutter, US publication 2011-0185644.

Although the known temporary shelter kits have some utility for their intended purposes, a need still exists in the art for an improved, simplified, temporary shelter kit which is capable of being stored in a compact and stackable configuration, which is capable of quickly being assembled with a minimal number of tools, and which does not require a high level of mechanical skill to assemble.

SUMMARY OF THE INVENTION

Accordingly, it is an object of the present invention to provide a portable kit for assembling to form a temporary, hard-shelled structural shelter, with an extended life cycle. It is another object of the present invention to provide a method of using such a kit.

In order to achieve the above objects, the present invention according to a first aspect thereof provides a kit including a minimum of six prefabricated components usable to build a temporary housing structure.

The kit according to the first aspect includes a top shell member which includes a generally flattened first main panel section having a first shape and a first edging portion attached to and surrounding the first main panel section, the first edging portion including a plurality of segments each oriented substantially transverse to the first main panel section.

All members may be made with a lightweight "sandwich-type" construction, including interior and exterior surface layers formed from durable plastic, fiberglass or composite material and a middle layer made of a lightweight insulating foam or honeycomb. The top, bottom and side walls are not only light weight but also provide an assembled strength and high R-Value. The structure may be made to withstand weight loads up to 4000 pounds or more.

The kit also includes a bottom shell member which includes a generally flattened second main panel section having a shape which is similar to the shape of the first main panel section, and a second edging portion attached to and surrounding the second main panel section, the second edging portion also including a plurality of segments each oriented substantially transverse to the second main panel section.

The bottom shell member may, optionally, be provided with a textured floor surface on the interior thereof to aid an occupant in getting a good foothold thereon. In addition, if desired, a built-in floor drain may also be provided as part of the floor section of the bottom shell member, the drain leading to an outlet at a lower edge surface of the shell member for ease of cleaning.

The kit also includes a plurality of generally flattened side wall sections, each of the side wall sections having a width corresponding to one of the segments of the first edging portion, and further includes first and second generally flattened end wall sections. A door is provided in any wall section such as the first end wall section, and each of the end wall sections has a width corresponding to a selected segment of the first edging portion. The door may include a first window including a sliding panel and screen.

Optionally, a second window or multiple windows may be provided any of the other wall sections, and where used, such a second window may also be provided with a sliding panel and screen. Where windows are provided in both the door and another wall section, a user of the assembled structure may open both of the windows and obtain cross-flow ventilation. A small vent or vents may also be provided as well.

The top shell member and the bottom shell member are configured to be attachable to one another to form a relatively thin stackable sealed or water tight shipping container, with all of the wall sections contained inside of the shipping container in a stacked configuration.

The end wall sections are alignable with the side wall sections and with the top and bottom shell members to form a temporary housing structure.

In another aspect of the invention, the kit may further include a plurality of flexible mats used during shipping and storage to protect internal components from damage, and which can be vertically stacked after unpacking the kit to form a sleeping mattress.

In yet another aspect of the invention, the top and bottom shell members may each be provided with a plurality of fastening members such as for example, concealed draw latch fasteners which may cooperate with pins provided on outer top, bottom and side edge portions of each of the wall sections, to aid in the rapid assembly of the temporary structure. Where used, such fastening members may also include cylindrical actuation portions which extend out to the edge segments of the associated shell members, and having an inner portion which is configured to be engaged by a turning tool. All assembly hardware may be completely captured in the top, bottom and side edges of the structural panels with no ability to become lost during shipping, assembly or disassembly.

During shipping storage and arrival the kit outer access points allow for ease of disassembly and immediate assembly. The outer shell access points do not allow for disassembly after the kit is constructed as the inner shell and wall system assembly points lock the kit from outer access.

All hardware is field replaceable and repairable as are the compsite panels.

In still another aspect of the invention, the kit may additionally include suitable anchoring hardware, such as 2 or more earth anchor screws and an equal number of ratcheting straps or tiedowns, which attach to support members, such as eyelets on exterior surface of the bottom shell member.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

It should be understood that only structures and methodology needed for illustrating selected embodiments of the present invention are described herein. Other conventional structures, and those of ancillary and auxiliary components of the system, will be known and understood by those skilled in the art.

Figure 1:
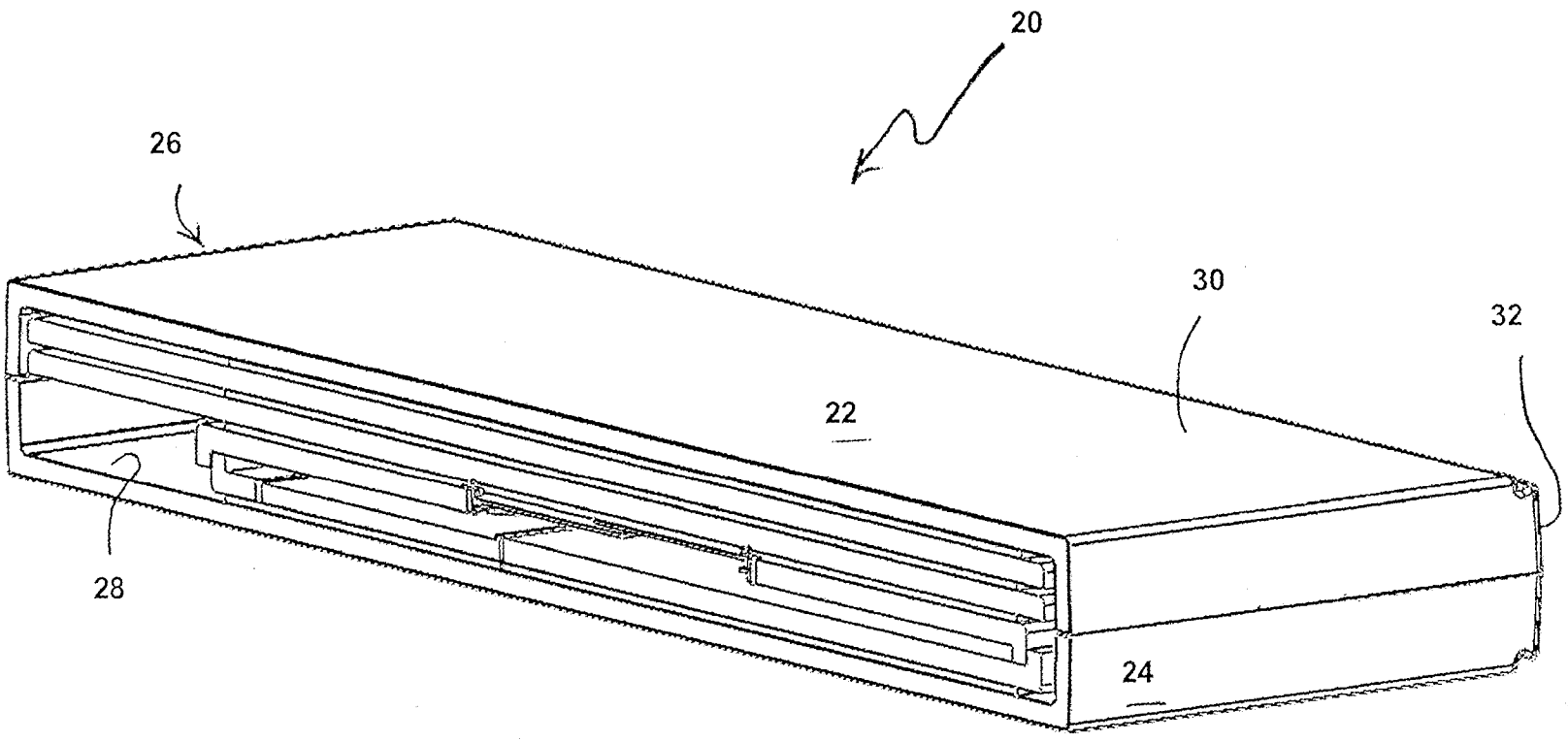
FIG. 1 is a perspective view, partially shown in cross-section, of a kit according to a first embodiment of the present invention, shown assembled for shipping.
Figure 2:
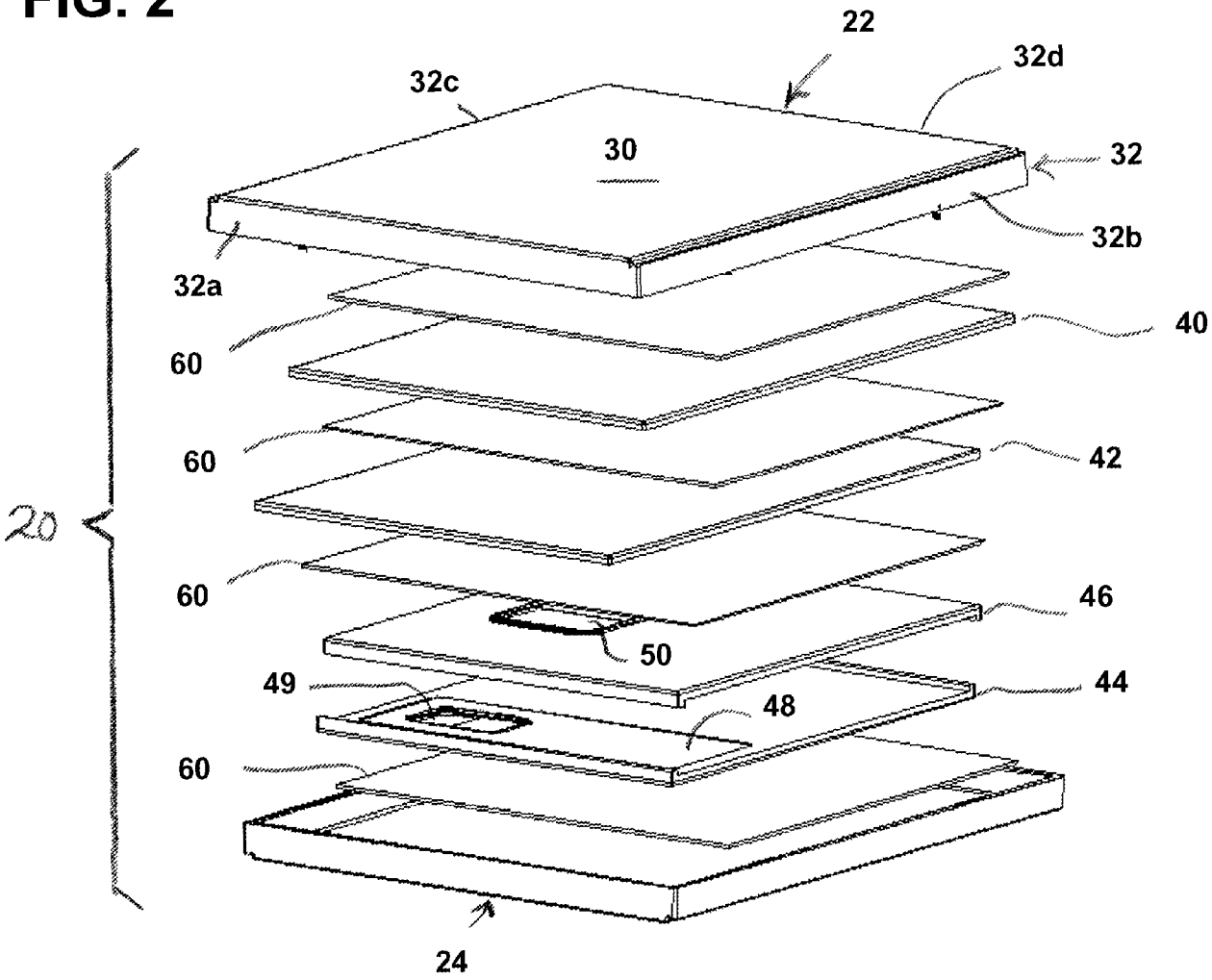
FIG. 2 is an exploded perspective view of the kit of FIG. 1.

An illustrative embodiment of a kit of prefabricated components usable to build a temporary housing structure will now be described, with reference to the drawings. The kit is shown generally at 20 in FIGS. 1-2, with FIG. 1 being an assembled shipping configuration shown partly in cross-section, and FIG. 2 being an exploded perspective view.

The kit 20 according to the illustrative embodiment includes a top shell member 22 and a bottom shell member 24, which fit together to define a hollow shipping case 26, which has a hollow space 28 formed therein. The top shell member 22 and the bottom shell member 24 serve dual functions, first, as components of a structural shipping case 26, and second, as roof and floor elements of an assembled temporary structure 100, shown in FIGS. 3 and 4. All other components of the kit 20, which will be further described herein, fit inside of the shipping case 26 in a substantially stacked configuration.

Figure 3B:
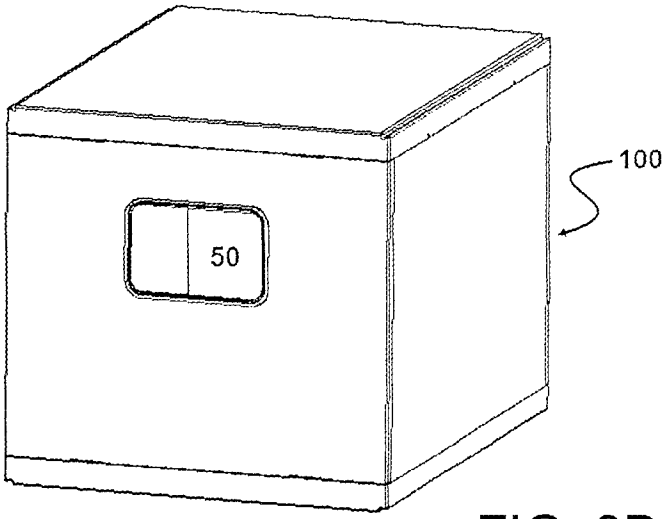
FIG. 3B is a second perspective view of the housing structure of FIG. 3, shown from a second vantage point.
Figure 3A:
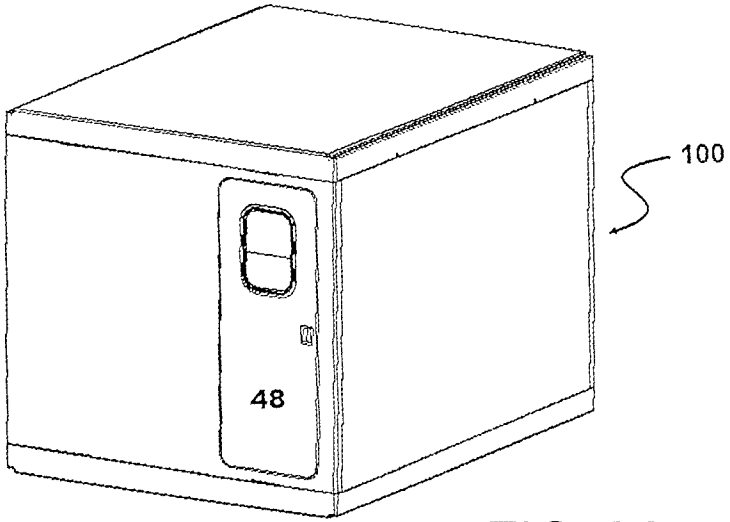
FIG. 3A is a first perspective view of a housing structure constructed using the kit of FIGS. 1-2, shown from a first vantage point.

The top shell member 22 includes a generally flattened first main panel section 30 having a first shape, which is rectangular in the depicted configuration. The top shell member also includes a first edging portion 32 integrally attached to and surrounding the first main panel section, the first edging portion including a plurality of segments 32*a*, 32*b*, 32*c* and 32*d*, each oriented substantially transverse to the first main panel section. Each of the segments of the top shell member has a distal edge spaced away from the main panel section 30, as shown. Optionally, the distal edges of the top shell member 22 may all lie in a common plane, as shown in FIGS. 3A-3B. The bottom shell member 24 has a structure similar to that described for the top shell member 22, except as specified otherwise herein.

Figure 9:
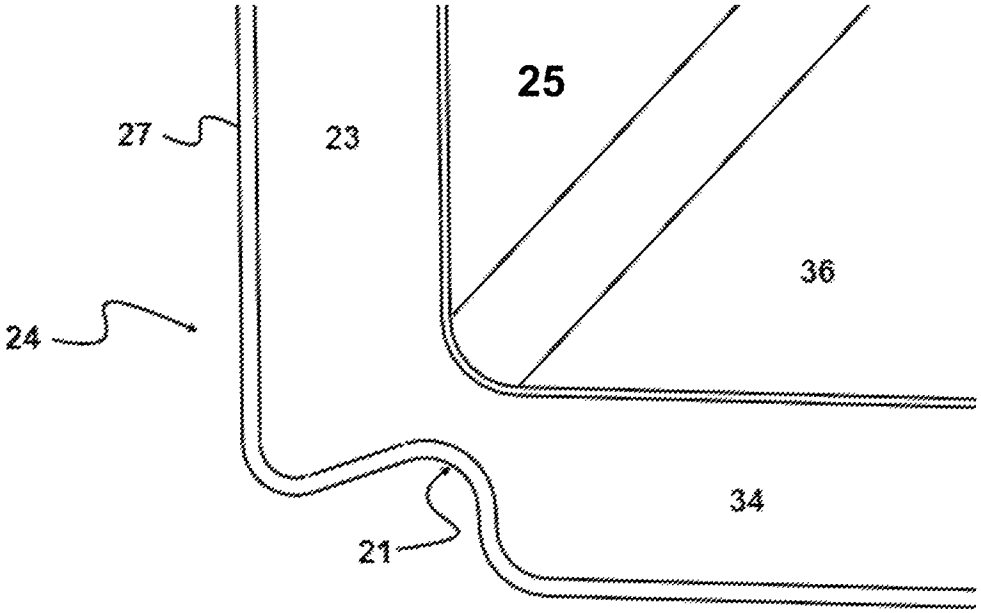
FIG. 9 is a detail perspective view, partially shown in cross-section, of the bottom shell member in a modified embodiment.
Figure 10:
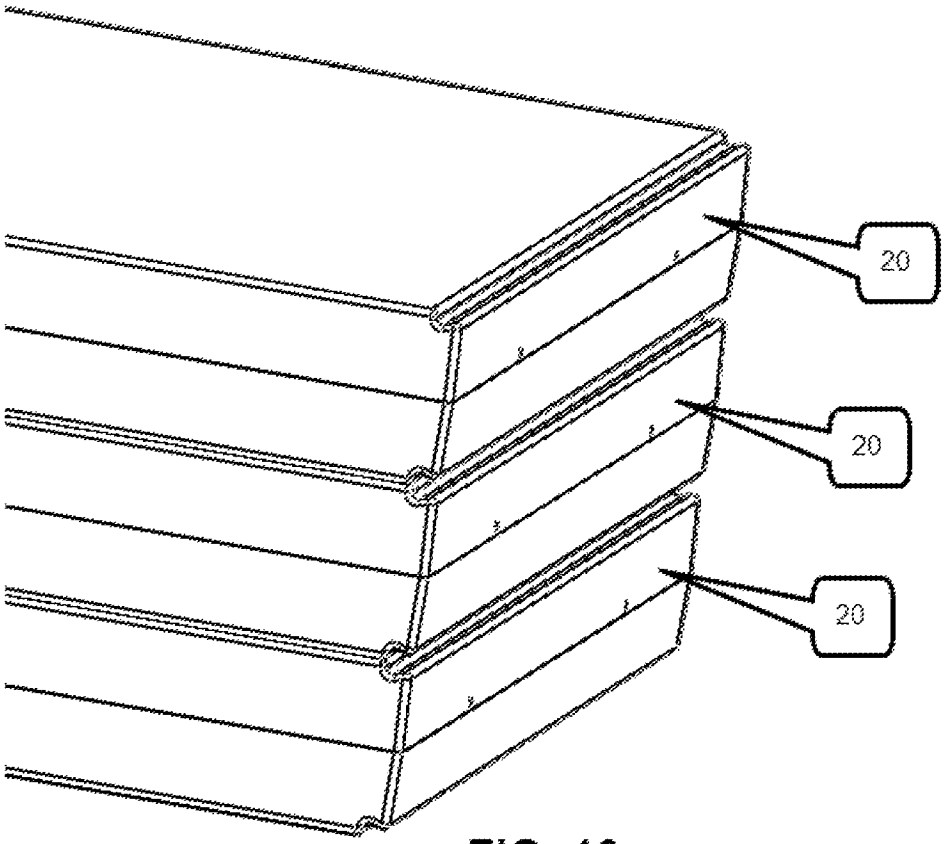
FIG. 10 is a perspective view of three of the kits of FIG. 1 assembled for shipping and shown arranged in a stacked configuration.

As shown in FIG. 9, each of the top and bottom shell members 22, 24 may be made with a lightweight "sandwich-type" construction. The bottom shell member 24 is shown in FIG. 9 including interior and exterior surface layers 25, 27 each formed from durable plastic or fiberglass or composite material, and a middle layer 23 made of a lightweight insulating foam material. If desired, the material used for the middle foam layer 23 may be fire-resistant.

Figure 4:
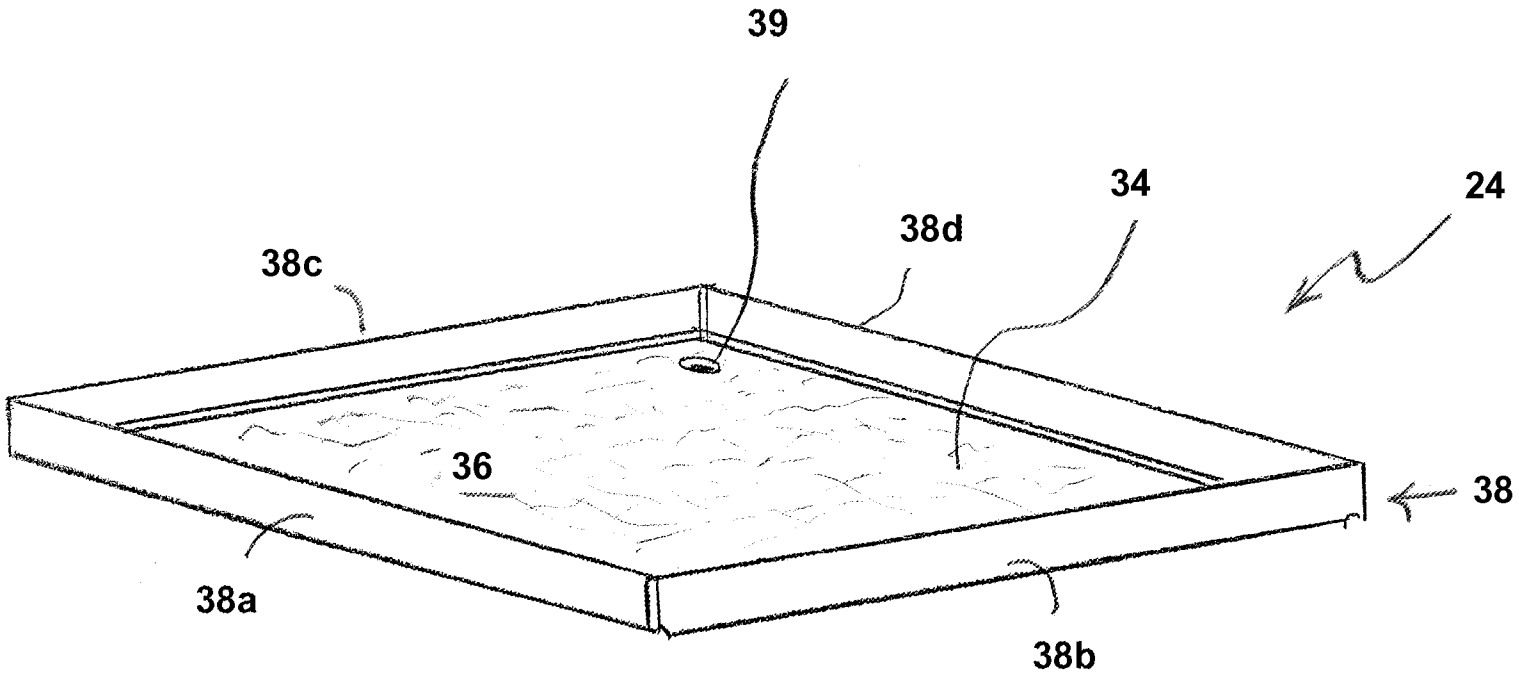
FIG. 4 is a perspective view of a bottom shell member which is a component part of the kit of FIGS. 1-2.
Figure 5:
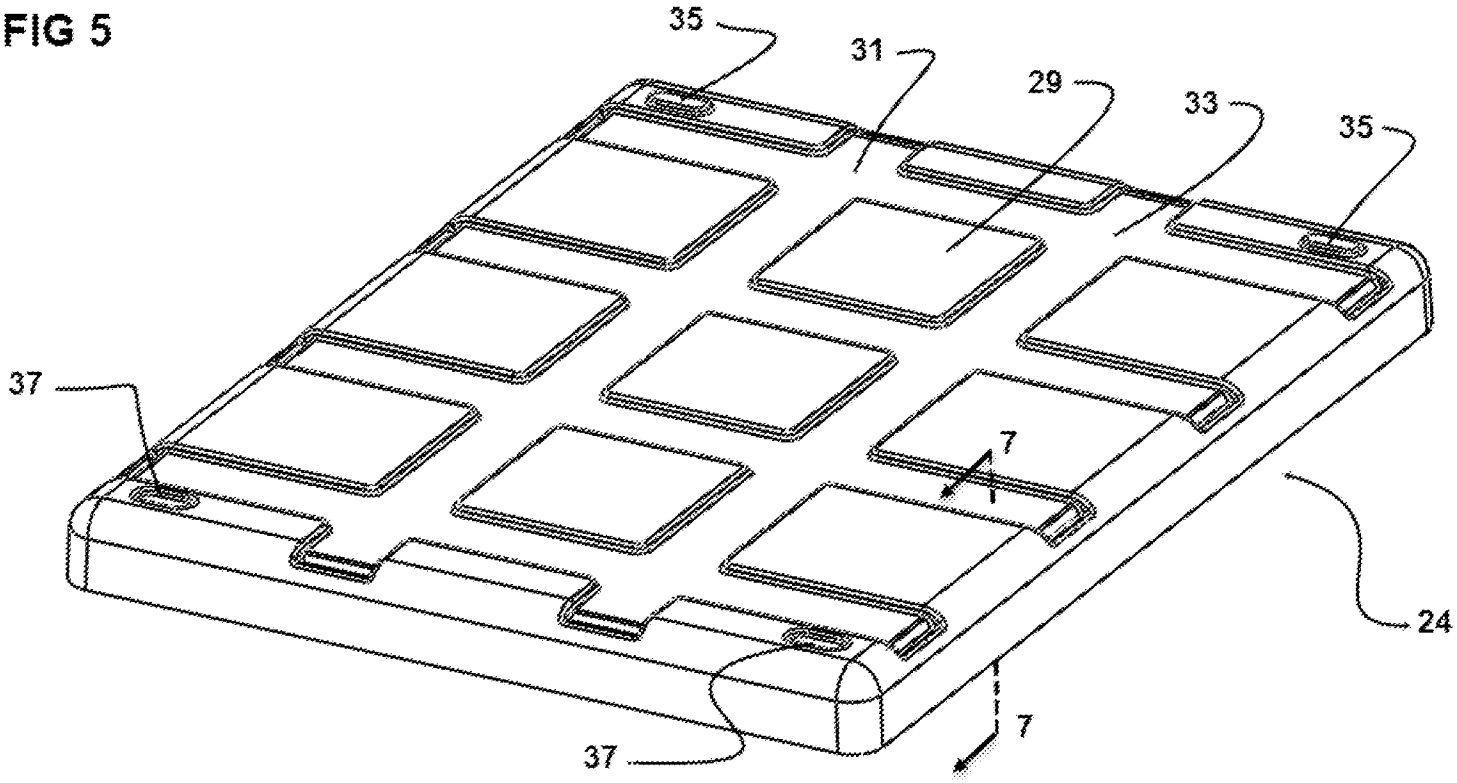
FIG. 5 is an inverted perspective view of the bottom shell member of FIG. 4, showing structural features on the underside thereof.
Figure 6:
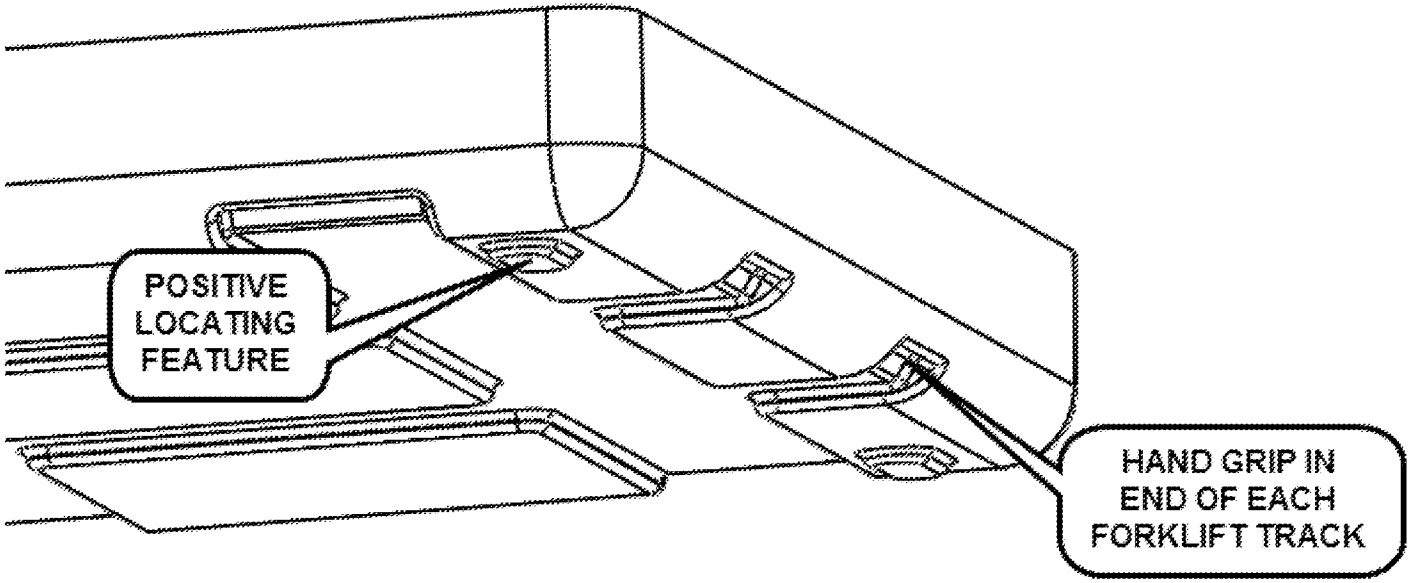
FIG. 6 is a detail perspective view showing an end portion of the bottom shell member of FIGS. 4-5.

As previously noted, and as seen best in FIGS. 4-5, the kit 20 also includes a bottom shell member 24 which includes a generally flattened second main panel section 34 having a shape which is similar to the shape of the first main panel section 30 of the top shell member 22. The bottom shell member 24 also includes a second edging portion attached to and surrounding the second main panel section, the second edging portion 38 also including a plurality of segments 38*a*, 38*b*, 38*c* and 38*d*, each integrally attached to and oriented substantially transverse to the second main panel section 34.

The bottom shell member 24 may, optionally, be provided with a textured floor surface 36 on the interior thereof, at the upper surface of the second main panel section 34, in order to aid an occupant in getting a good foothold thereon.

In addition, if desired, a built-in floor drain 39 may also be provided as part of the floor section of the bottom shell member, the drain leading to an outlet (not shown) at a lower edge surface of the shell member 24. It will be understood that where a floor drain 39 is used, the floor surface 36 may be gently sloped toward the floor drain to facilitate any fluid drainage via gravity flow.

Referring now to FIG. 5, the bottom shell member 24 is shown in an inverted configuration. It will be seen that a lower surface 29 of the bottom shell member 24 may be provided with a number of shaped structural features to aid in storage, transportation and assembly of the kit 20. A plurality of recessed, parallel forklift tracks or slots, such as those shown at 31 and 33, may be molded into the lower surface 29 of the bottom shell member. In the drawing, transverse sets of intersecting tracks are shown forming a grid to increase rigidity. Alternatively, if desired, the lower surface 29 of the bottom shell member 24 may be provided with only two parallel forklift tracks 31, 33. These forklift tracks 31, 33 may be spaced a suitable distance apart to receive the tines of a forklift truck therein, in order to facilitate movement of the kits during loading or shipment or in a storage warehouse, or else to facilitate movement of the assembled structures.

Where used, each of the forklift tracks 31, 33 is provided with a recessed handgrip formed as a deep corner groove 21 (FIG. 7) extending inwardly into the underside of the bottom shell member 24 at an outer edge of each of the forklift tracks 31, 33.

In addition, a first side edge portion of the bottom shell member may be provided with two spaced apart first alignment structures 35 formed as outwardly extending bosses on the outer surface of the shell member, with corresponding inner recesses inside of the shell member for nesting purposes. In contrast, a second side of the bottom shell member may be provided with two spaced apart second alignment structures 37 formed as inwardly extending sockets on the outer surface of the shell member, with corresponding inner protrusions inside of the shell member.

Alternatively, if desired, both sides of the bottom shell member may be provided with identical alignment structures.

Referring once again to FIG. 2, the kit 20 also includes a plurality of generally flattened side wall sections 40, 42, each of the side wall sections having a width corresponding to one of the segments 32*a*, 32*b*, 32*c* or 32*d* of the first edging portion.

The kit 20 further includes first and second generally flattened end wall sections 44, 46. A door 48 is provided in the first end wall section 44, and each of the end wall sections has a width corresponding to a selected segment 32*a*, 32*b*, 32*c* or 32*d* of the first edging portion.

Figure 8:
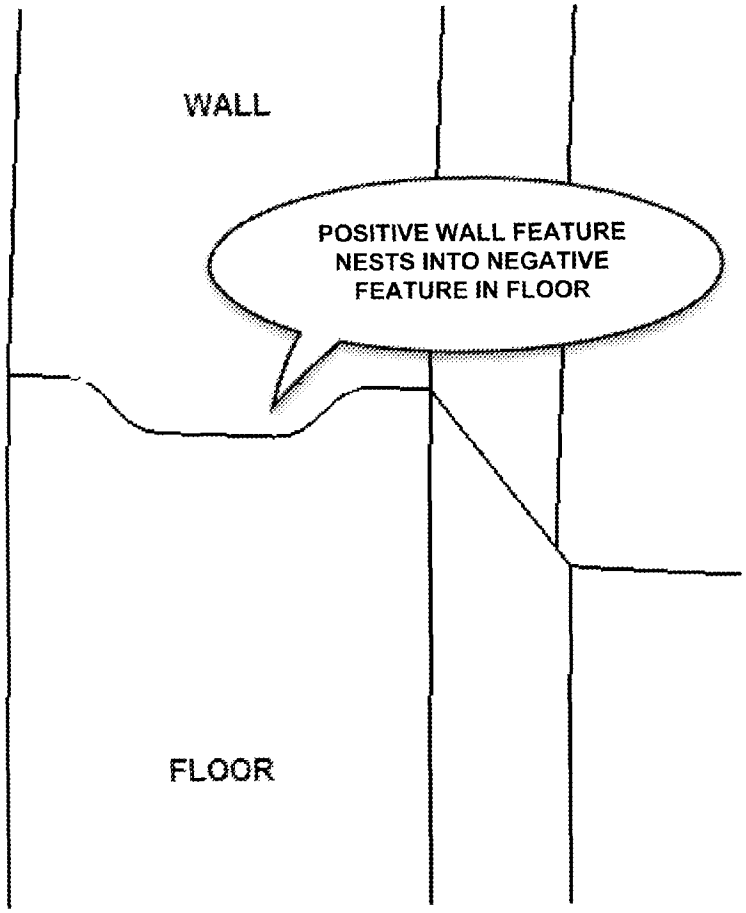
FIG. 8 is a detail sectional view showing alignment members in a wall section and floor section during assembly.

The end wall sections 44, 46 are alignable with the side wall sections 40, 42 and with the top and bottom shell members 22, 24 to form a temporary housing structure 100. Referring now to FIG. 8, it will be seen that complimentary alignment structures on one of the wall sections and on the bottom shell member 24 may be used to properly align these components relative to one another during assembly.

The door 48 may include a first window 49, including a sliding panel and a screen. Optionally, a second window 50 may be provided in the second end wall section or in one or both of the side wall sections, and where used, such a second window may also be provided with a sliding panel and screen. Where windows are provided in both the door and another wall section, a user of the assembled structure may open both of the windows and obtain cross-flow ventilation. Additional vents can be added if necessary.

As noted above, the top shell member 22 and the bottom shell member 24 are configured to be attachable to one another to form a relatively thin stackable shipping container 26 in which the distal edges of the top shell member 22 contact the distal edges of the bottom shell member 24 to form a closed container having a hollow spaced formed therein, and all of the wall sections 42, 44, 46 and 48 fit inside of the shipping container in a vertically stacked configuration, either for shipping or for short or long term storage until needed.

Figure 7:
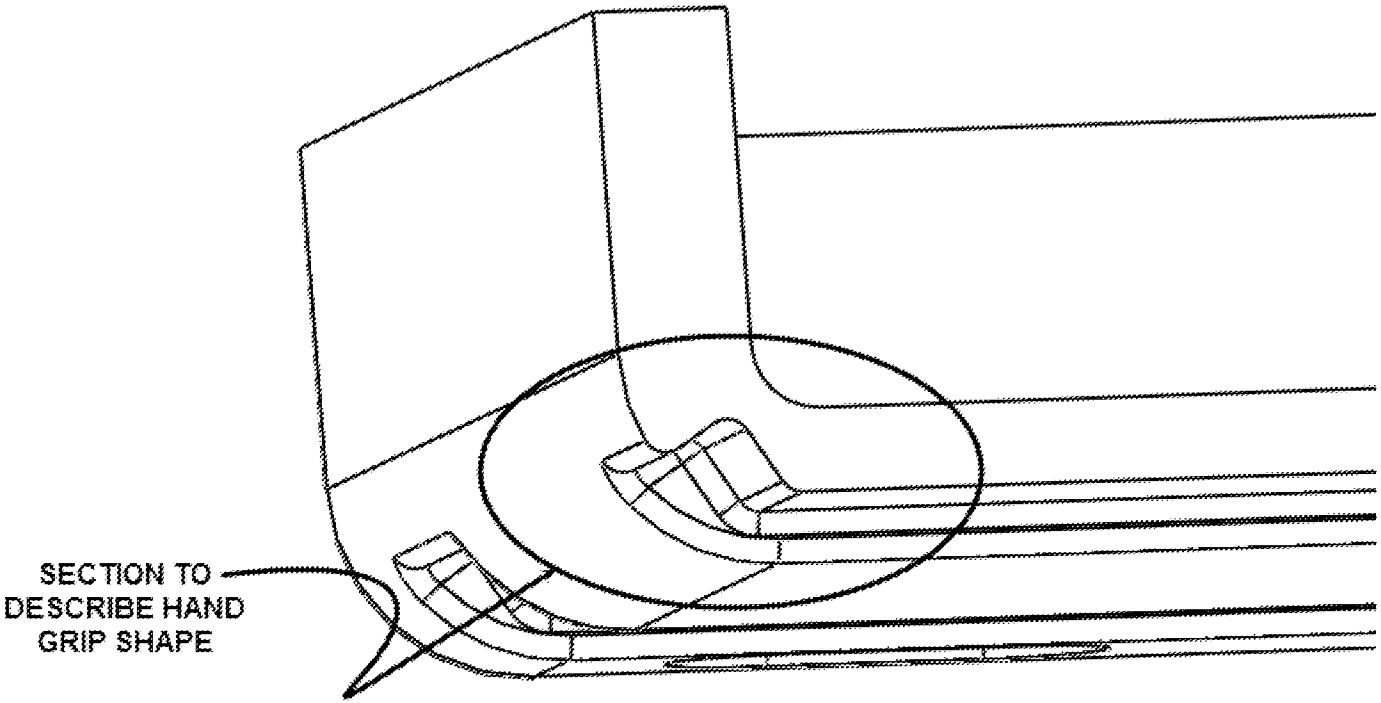
FIG. 7 is a detail perspective view, partially shown in cross-section, of the bottom shell member, taken along the line 7-7 in FIG. 5.

Referring now to FIGS. 7 and 9, it will be seen that each of the top and bottom shell members 22, 24, respectively, has a corner groove 21 formed therein, which may extend along the junction between the main panel section 34 and the corresponding edging portion. Alternatively, the corner groove 21 may be provided only at the ends of the forklift tracks 31, 33 on the bottom shell member 24, as shown. These grooves 21 create handholds on the edges of the cases 26, enabling users to grab and lift an upper kit 20 from the top of a stack of such kits. This permits convenient storage and manipulation of the kits 20 in warehouses, on transport vehicles such as trucks, planes or ships, and in a disaster recovery area where the kits are to be assembled to form housing.

In another aspect of the invention, the kit may further include a plurality of flexible mats 60 which can be folded and/or vertically stacked to form one or more mattresses. Additionally a bunk bed application may also be included (not shown).

Figure 11A:
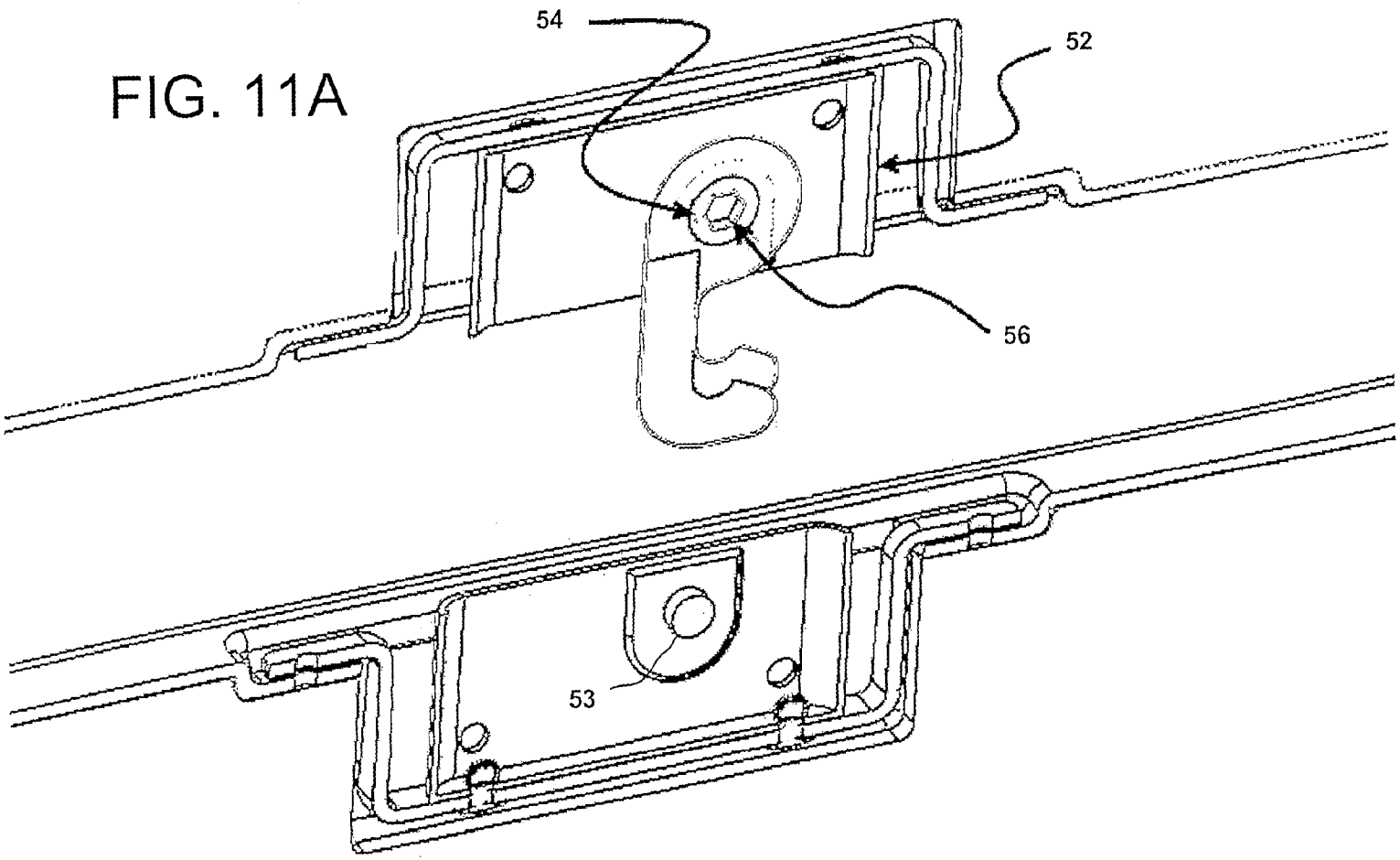
FIG. 11A is a first detail perspective view of a latch mechanism, which is part of the housing structure of FIGS. 3A-3B, shown in an open and separated configuration.
Figure 11B:
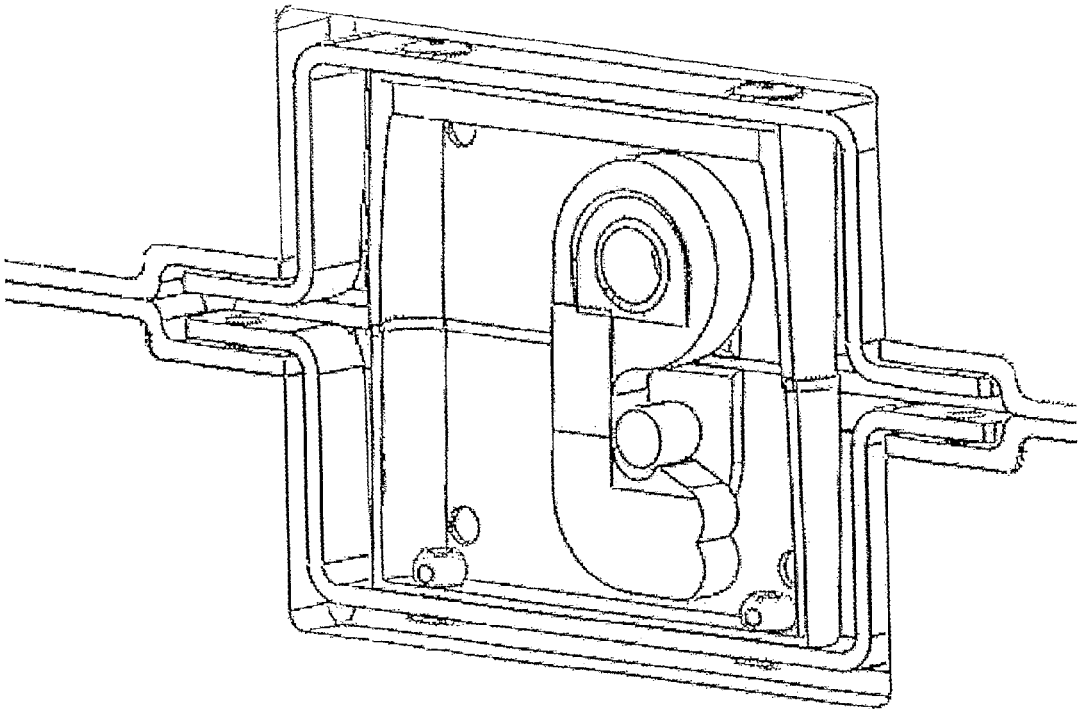
FIG. 11B is a second detail perspective view of the latch mechanism of FIG. 11A, shown in a closed and latched configuration.

In yet another aspect of the invention, the top and bottom shell members 22, 24 may each be provided with a plurality of fastening members such as for example, concealed draw latches 52 (FIGS. 11A-11B) which may cooperate with pins 53 provided on outer top and bottom edge portions of each of the wall sections 42, 44, 46, 48, to aid in rapid assembly of the temporary structure 100. Such fastening members may also include cylindrical actuation portions 54 which extend out to the edge segments of the associated shell members, and having an inner portion 56 which is configured to be engaged by a turning tool, such as a hex wrench, Allen wrench or similar tool.

In addition to the components previously described, the kit 20 may additionally include one or more blankets (not shown).

Figure 12:
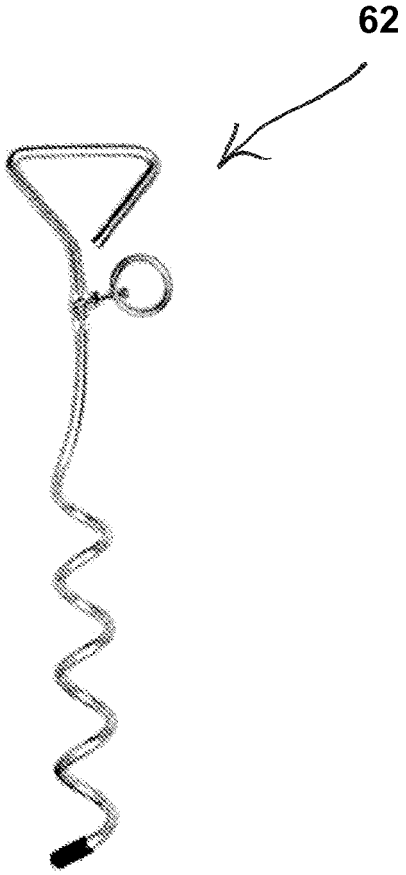
FIG. 12 is a perspective view of an earth anchor screw, which is an optional component of the kit of FIG. 1.

In still another aspect of the invention, the kit 20 may additionally include suitable anchoring hardware, such as 2 or more earth anchor screws 62 (FIG. 12) and an equal number of ratcheting straps or tiedown assemblies (not shown), which attach to, and extend between the earth anchor screws and suitable support members, such as eyelets or hooks provided on an exterior surface of one of the shell members. The ratchet mechanisms for the ratcheting straps can be similar to those disclosed in U.S. Pat. No. 4,199,182, the entire disclosure of which is incorporated by reference herein. Such ratcheting straps or tiedowns assemblies are well known and widely commercially available.

The present invention also relates to a method of using the kit 20 to construct a temporary building 100 which may be used for shelter or for storage.

The method includes a first step of providing a kit as previously described herein.

The method then includes a step of assembling the top and bottom shell members 22, 24 with the walls 40, 42, 44 and 46 aligned vertically therebetween along the edge portions, and attaching the shell members to the respective walls to form the building.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the attached claims, are intended to be within the scope and spirit of the present invention.

The invention claimed is:

1. A kit of prefabricated components usable to build a temporary housing structure, said kit comprising:

a top shell member which comprises a generally flattened first main panel section having a first shape, and a first edging portion attached to and surrounding the first main panel section, the first edging portion comprising a plurality of segments each oriented substantially orthogonal to the first main panel section, each of the segments of the top shell member having a distal edge spaced away from the main panel section, wherein a first corner groove is formed in the top shell member at a junction between the main panel section and a corresponding adjacent edging portion, the first corner groove configured to accommodate a hand of a user;

a bottom shell member which comprises a generally flattened second main panel section similar to the shape of the first main panel section, and a second edging portion attached to and surrounding the second main panel section, the second edging portion comprising a plurality of segments each oriented substantially orthogonal to the second main panel section, each of the segments of the bottom shell member having a distal edge spaced away from the main panel section thereof, wherein a second corner groove is formed in the bottom shell member at a junction between the second main panel section and a corresponding adjacent edging portion, the second corner groove configured to accommodate a hand of a user;

a plurality of generally flattened side wall sections, each of the side wall sections having a width corresponding to one of the segments of the first edging portion; and first and second generally flattened end wall sections with a door provided in the first end wall section, each of the end wall sections having a width corresponding to one of the segments of the first edging portion; the end wall sections alignable with the side wall sections;

wherein:

the top shell member and the bottom shell member are configured to be attachable to one another to form a relatively thin stackable shipping container in which the distal edges of the top shell member contact the distal edges of the bottom shell member to form a closed container having a hollow spaced formed therein, all of the wall sections fit inside of the shipping container in a stacked configuration, and the top and bottom shell members are configured so that when a first kit is stacked on top of an identical second kit, the groves of the shell members are alignable and a channel is defined between the kits to receive a hand of a user to facilitate lifting and manual movement of the first kit.

2. The kit of claim 1, further comprising a plurality of flexible mats which can be vertically stacked to form a mattress.

3. The kit of claim 1, wherein the bottom shell member has a textured floor formed therein.

4. The kit of claim 1, further comprising at least two anchor screws usable for fixing the housing structure in place after assembly.

5. The kit of claim 1, wherein the bottom shell member has a floor section with a floor drain formed therein.

6. The kit of claim 1, wherein the door formed in the first wall section includes a first window, and another one of the walls sections has a second window formed therein to permit flow through ventilation.

7. The kit of claim 1, wherein the top shell member and the bottom shell member are attachable to one another to define said shipping container in a sealed manner configured to resist entry of water therein.

8. The kit of claim 1, wherein the distal edges of the top shell member all lie in a common plane which is a first plane, and the distal edges of the bottom shell member all lie in a common plane which is a second plane, in an assembled shipping configuration of the kit, the first and second planes are aligned with one another.

9. The kit of claim 1, wherein the bottom shell member is provided with a recessed handgrip formed as a corner groove extending inwardly into the underside thereof.

10. The kit of claim 1, wherein a lower edge of at least one of the wall sections is provided with a first alignment structure, and an edge portion of the bottom shell member configured to support said at least one of the wall sections is provided with a second alignment structure which is configured to nestingly engage with the first alignment structure.

11. A kit of prefabricated components usable to build a temporary housing structure, said kit comprising:

a top shell member which comprises a generally flattened first main panel section having a first shape and a first edging portion attached to and surrounding the first main panel section, the first edging portion comprising a plurality of segments each oriented substantially orthogonal to the first main panel section, each of the segments of the top shell member having a distal edge spaced away from the main panel section, wherein a first corner groove is formed in the top shell member at a junction between the main panel section and a corresponding adjacent edging portion, the first corner groove configured to accommodate a hand of a user;

a bottom shell member which comprises a generally flattened second main panel section similar to the shape of the first main panel section, said bottom shell member having an upper surface and a lower surface, and the lower surface is provided with at least two, spaced apart, parallel forklift tracks to receive the tines of a forklift, and a handgrip is formed as a second corner groove extending inwardly into the bottom shell member at an outer edge of the forklift tracks;

a second edging portion attached to and surrounding the second main panel section, the second edging portion comprising a plurality of segments each oriented substantially orthogonal to the second main panel section, each of the segments of the bottom shell member having a distal edge spaced away from the main panel section thereof, wherein the second corner groove is formed in the bottom shell member at a junction between the second main panel section and a corresponding adjacent edging portion, the second corner groove configured to accommodate a hand of a user;

a plurality of generally flattened side wall sections, each of the side wall sections having a width corresponding to one of the segments of the first edging portion; and first and second generally flattened end wall sections with a door provided in the first end wall section, each of the end wall sections having a width corresponding to one of the segments of the first edging portion; the end wall sections alignable with the side wall sections;

wherein:

a lower edge of at least one of the wall sections is provided with a first alignment structure, and an edge portion of the bottom shell member configured to support said at least one of the wall sections is provided with a second alignment structure which is configured to nestingly engage with the first alignment structure;

the top shell member and the bottom shell member are configured to be attachable to one another to form a relatively thin stackable shipping container in which the distal edges of the top shell member contact the distal edges of the bottom shell member to form a closed container having a hollow spaced formed therein all of the wall sections fit inside of the shipping container in a stacked configuration, and the top and bottom shell members are configured so that when a first kit is stacked on top of an identical second kit, the grooves of the shell members are alignable and a channel is defined between the kits to receive a hand of a user to facilitate lifting and manual movement of the first kit.

* * * * *